US006246161B1

(12) United States Patent
Kawamura et al.

(10) Patent No.: US 6,246,161 B1
(45) **Date of Patent: *Jun. 12, 2001**

(54) CATHODE RAY TUBE HAVING A SMALL-DIAMETER NECK AND METHOD OF MANUFACTURE THEREOF

(75) Inventors: Takao Kawamura, Chiba; Hisashi Nose; Eisuke Inoue, both of Mobara, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/159,061

(22) Filed: Sep. 23, 1998

Related U.S. Application Data

(63) Continuation of application No. 08/521,222, filed on Aug. 30, 1995, now Pat. No. 5,818,155.

(30) Foreign Application Priority Data

Sep. 13, 1994 (JP) ..... 6-218907
Nov. 25, 1994 (JP) ..... 6-291328

(51) Int. Cl.[7] ..... H01J 5/48; H01J 5/50

(52) U.S. Cl. ..... 313/318.05; 313/477 R; 313/318.01

(58) Field of Search ..... 313/477 R, 51, 313/318.05, 318.06, 318.12, 318.01

(56) References Cited

U.S. PATENT DOCUMENTS

| | | | |
|---|---|---|---|
| Re. 34,339 | 8/1993 | Osakabe . | |
| 4,040,707 | 8/1977 | Pisano . | |
| 4,040,708 | 8/1977 | Neuber et al. . | |
| 4,050,763 | 9/1977 | Smithgall . | |
| 5,178,572 | 1/1993 | Choi . | |
| 6,054,805 * | 4/2000 | Park et al. | 313/477 R |

FOREIGN PATENT DOCUMENTS

| | | |
|---|---|---|
| 1061301 | 5/1992 | (CN) . |
| 59-215640 | 7/1986 | (JP) . |
| 61-250933 | 11/1986 | (JP) . |
| 3-102741 | 4/1991 | (JP) . |
| 6-103897 | 4/1994 | (JP) . |
| 6-180237 | 2/1996 | (JP) . |

* cited by examiner

*Primary Examiner*—Nimeshkumar D. Patel
*Assistant Examiner*—Karabi Guharay
(74) *Attorney, Agent, or Firm*—Antonelli, Terry, Stout & Kraus, LLP

(57) ABSTRACT

A cathode ray tube has a vacuum envelope formed of a panel portion supporting a phosphor film on an inner surface thereof, a neck housing an electron gun, a funnel joining the panel and the neck, and a stem sealing an open end of the neck and mounting the electron gun via a plurality of pins extending through the stem. The inside diameters at the open end sealed by the stem and vicinities thereof become gradually larger toward the open end sealed by the stem, or retain at least a value substantially equal to an inside diameter of a major portion of the neck.

21 Claims, 13 Drawing Sheets

CATHODE RAY TUBE HAVING A SMALL-DIAMETER NECK AND METHOD OF MANUFACTURE THEREOF

CROSS REFERENCE TO RELATED APPLICATION

This is a continuation of U.S. application Ser. No. 08/521,222, filed Aug. 30, 1995, now U.S. Pat. No. 5,818,155, the subject matter of which is incorporated by reference herein.

BACKGROUND OF THE INVENTION

The present invention relates to a cathode ray tube and a method thereof, and more particularly to a cathode ray tube having a small-diameter neck housing a high performance electron gun and a large-diameter circular array of pins extending through a stem closing one end of the neck and mounting the electron gun thereon, and a method of manufacturing the same.

In general, a cathode ray tube includes a vacuum envelope formed with a panel having a phosphor film coated on its inner surface, a neck housing an electron gun, a funnel joining the panel and the neck, and a stem for closing an open end of the neck and for mounting the electron gun thereon.

In general, six potentials are applied to a color cathode ray tube, including a cathode potential, a control grid potential, an accelerating electrode potential, a focus electrode potential, an anode potential, and a heater potential for heating the cathode.

The heater is formed to pass 200 to 700 mA through two stem pins with a voltage of 5 to 10 V applied between them.

The cathode is supplied with a cathode potential as a display signal to generate an electron beam. The control grid is supplied with a potential of 0 to 200 V.

The accelerating electrode has the accelerating potential of 200 to 1,000 V applied thereto. The focus electrode has the focus potential of 5 to 10 kV applied thereto.

The anode has the anode potential of 20 to 35 kV applied thereto.

The stem pin for applying a high voltage of 5 to 10 kV to the focus electrode is separated from adjacent stem pins a distance of two or more times a regular interval between other two adjacent stem pins to prevent arcing therebetween.

The electron gun structured as described above operates as follows.

The thermoelectrons emitted from the cathode heated by the heater are accelerated toward the control grid by the accelerating potential to form three electron beams.

Each of the three electron beams passes through an aperture of the control grid, an aperture of the accelerating electrode, is focused to some extent by a prefocus lens formed between the accelerating electrode and the focus electrode before entering a main lens formed between the focus electrode and the anode and enters the main lens as accelerated by the focus electrode potential.

The three electron beams are respectively focused by the main lens on a phosphor screen to form a beam spot.

The high voltage to be applied to the anode is supplied via a so-called anode button embedded in the funnel forming an envelope of the cathode ray tube.

The prior cathode ray tube of the type was disclosed in the Japanese Patent Application Laid-Open No. 59-215640.

The prior cathode ray tube having the electron gun described above has the disadvantage that resolution at the periphery of the screen (phosphor film) is lowered as compared with that at the central area.

A chief cause of the lower resolution is astigmatism enhanced due to non-homogeneity of magnetic fields of a self-convergent deflection yoke used generally for scanning the phosphor screen by the electron beams. Another chief cause of the lower resolution is that a focusing condition of the electron beams at the central area of the screen is different from that at the periphery since a distance from the main lens to the periphery is longer than that to the central area.

To solve the problem of lower resolution at the periphery of the screen, it is disclosed in the Japanese Patent Application Laid-Open No. 61-250933 that a focus electrode is divided into at least a first focus electrode and a second focus electrode to form an electrostatic quadrupole lens on their opposing ends and to apply on one of the first and second focus electrodes a voltage dynamically varying according to an angle of deflection of the electron beams.

However, to apply the dynamically varying voltage to a focus electrode, an additional stem pin is required. A problem arises that the increased number of stem pins on a limited size of the stem results in decrease in intervals between the adjacent stem pins so that potential differences between the stem pins is prone to cause arcing therebetween, and a withstand voltage characteristic deteriorates.

A cathode ray tube is proposed in the Japanese Patent Application No. Hei 6-180237 filed in the Japanese Patent Office on Aug. 1, 1994, assigned to the same assignee as the present application, but not laid-open at the time of filing of the present application, wherein to solve a problem of degradation in resolution at the periphery of the screen, a focus electrode is divided into two electrodes to form an electrostatic quadrupole lens therebetween and to apply different voltages on the two focus electrodes, but an electrical interconnection of one end of a heater and a control grid makes an additional stem pin unnecessary despite an increase in the number of electrodes, as described below referring to FIG. 10.

FIG. 10 depicts a cross-sectional view illustrating an electron gun having a focus electrode divided into first and second focus electrodes and voltages applied to the electrodes. In the figure are indicated the heater 21, the cathode 22, the control grid 23, the accelerating electrode 24, the focus electrode 25, the first focus electrode 251 and the second focus electrode 252, and the anode 26.

One end of the heater 21 and the control grid 23 are connected to a common stem pin.

In the figure also are indicated the potential difference Ef across the heater 21, the cathode potential Ek, the control grid potential Ec1, the accelerating electrode potential Ec2, the first focus electrode potential Vf1 and the second focus electrode potential Vf2, and the anode potential Eb.

One of the first focus electrode potential Vf1 and the second focus electrode potential Vf2 is a dynamic voltage that varies in synchronization with a deflection angle of the electron beams.

The other end of the heater 21 that is not connected to the common stem pin connected with the control grid has the potential difference Ef or −Ef applied thereto with respect to the variable control grid potential Ec1. The potential difference applied across the heater 21 therefore is constant even if the variable control grid potential Ec1 changes.

Since the focus stem pins for giving the potential Vf1 to the first focus electrode and for giving the potential-Vf2 to the second focus electrode are at far higher potentials than the other stem pins for giving the required potential to the other electrodes, the focus stem pins are separated from adjacent stem pins a distance of two or more times a regular interval between other two adjacent stem pins to prevent arcing between the focus pins and the other stem pins.

As described above, a focus electrode is divided into two electrodes to form an electrostatic quadrupole lens therebetween and to apply different voltages on the two focus electrodes, but an electrical interconnection of one end of a heater and a control grid makes an additional stem pin unnecessary despite an increase in the number of electrodes, thereby avoiding narrow intervals between adjacent stem pins to prevent deterioration of withstand voltage characteristics which result in arcing between adjacent stem pins.

For example, a neck having an inside diameter of not smaller than 19.1 mm but smaller than 23.1 mm of a cathode ray tube is sealed with a stem having a circular array of stem pins arranged on a circumference of a diameter smaller than 12.2 mm. A circle for stem pins to be arranged on may be called a pin circle hereinafter.

FIG. 7 depicts a partial cross-sectional view illustrating a major portion of a vacuum envelope of a cathode ray tube. In the,figure are indicated the vacuum envelope, the so-called bulb 1, a panel 2, a phosphor film 3, a neck 4, a funnel 5, an electron gun 6, and a deflection yoke 7.

The vacuum glass envelope 1 is formed of a panel 2 on its front side having a phosphor film 3 on its inner surface, a tubular neck 4 on its rear side, and a cone-shaped funnel 5 joining the panel 2 and the neck 4.

The neck 4 is sealed to a small end of the funnel 5. The neck 4 houses the electron gun 6 for emitting electron beams.

The electron gun 6 is mounted on a glass stem (not shown). The stem is sealed to an open end of the neck 4.

The electron beams emitted from the electron gun 6 are deflected in two directions, horizontally and vertically, by the deflection yoke 7 mounted near a transitional area between the funnel 5 and neck 4. The deflected electron beams strike nearly the entire area of the phosphor film 3 formed on the inner surface of the panel 2. An example of the deflected electron beams is indicated by a broken line in FIG. 7.

SUMMARY OF THE INVENTION

The prior proposal in the Japanese Patent Application No. Hei 6-180237 has the following disadvantages. Since the prior proposal uses the stem pin for supplying the voltage to the heater 21 and the control grid 23 in common, leakage occurs between them to affect a displayed image. Also, since the prior proposal has to have an additional circuit for using the stem pin in common, the circuit causes unstable operation and increases the number of parts.

To solve the above-mentioned problems, the number of the stem pins should be increased. However, the diameter of a pin circle is too small to arrange all the necessary stem pins. For the reason, a cathode ray tube of a neck of an inside diameter not smaller than 19.1 mm but smaller than 23.1 mm cannot have an electron gun of the dynamic focus type having the two divided focus electrodes divided into two.

In view of solving the foregoing problems of the prior proposal, it is one object of the present invention to provide a cathode ray tube having a small-diameter neck and a large-diameter pin circle for stem pins of the number capable of supplying the necessary number of potentials to electrodes of the electron gun of the dynamic focus type.

Briefly, the foregoing first object is accomplished in accordance with aspects of the present invention by the cathode ray tube, comprising an electron gun having a cathode, a control grid, an accelerating electrode, a focus electrode, an anode, and a heater for heating the cathode at least and a stem having a plurality of stem pins for supplying required potentials to the electrodes and a heater, wherein a circular array of stem pins implanted in the stem for supporting the electron gun having the electrodes and supplying voltages to the electrodes has a diameter not smaller than 12.2 mm but not larger than 15.3 mm, and a neck housing the electron gun has an inside diameter not smaller than 19.1 mm but smaller than 23.1 mm.

That is, the present invention has optimized the diameter of the pin circle for practical use for the small inside diameter of the neck.

In such a structure, the cathode ray tube of the present invention has the advantage that it is possible to increase the number of stem pins since the stem having a pin circle not smaller than 12.2 mm but not larger than 15.3 mm is sealed to the neck of an inside diameter not smaller than 19.1 mm but smaller than 23.1 mm.

For example, if the stem has a pin circle of 15.24 mm diameter, the stem can have ten stem pins implanted therein. The cathode ray tube having the above-mentioned neck inside diameter can employ an electron gun of the dynamic focus type requiring nine or more stem pins.

As described above, the electron beams are deflected by the magnetic fields generated by the deflection yoke 7. Currents through coils of the deflection yoke 7 to produce the magnetic fields needed for the deflections of the electron beams can be made lower as the diameter of the neck 4 is smaller. In other words, a so-called small-diameter neck cathode ray tube can reduce power consumption. In this sense, it has been demanded that the diameter of the neck 4 should be made smaller.

However, there are limits to reducing the diameter of the neck 4.

FIG. 8 depicts a partial enlarged view illustrating the neck of the cathode ray tube before the stem is sealed to the neck. FIG. 9 depicts a partial enlarged view illustrating the neck of the cathode ray tube after the stem is sealed to the neck. Parts identical in FIGS. 8 and 9 are indicated by the same numbers. In the figures are indicated the stem 8 for mounting the electron gun (not shown), a flange 8' of the stem 8, an exhaust tubulation 9, the stem pins 10, elevated portions 13, and a V-groove 14.

The figures show only the neck 4 and the stem 8 with the electron gun omitted for ease of description.

The stem 8 has several to some ten metal pins 10 implanted therein on a circumference of a circle for mounting the electron gun. The stem 8 also has the mound-like elevated portion (hereinafter referred to as the mound) 13 formed on the side of the electron gun mounted thereon to increase strength of the glass. The stem 8 further has the flange 8' formed on the outmost side thereof.

The stem pins 10 must be separated some distance from one another to ensure electrical insulation between them. The circle for arranging the stem pins 10 cannot be made smaller without limit.

Further, the stem 8 has the exhaust tubulation 9 thereunder to evacuate gases inside the cathode ray tube. To make efficient the evacuation of the vacuum envelope through the exhaust tubulation 9, it is necessary that a diameter of the exhaust tubulation 9 should be made as large as possible.

With the background described above, as shown in FIG. 8, the inside diameter of the neck 4 cannot be made smaller than that of a circle circumscribing the group of mounds 13 of the stem 8 because it is desirable that all the mounds 13 of the stem 8 are positioned inside the neck 4 even before the neck 4 is sealed to the stem S.

In the process of sealing the stem 8 to the neck 4, the bottom (open end) of the neck 4 and a circumference of the stem 8 are heated to melt and are pressed together, and are pulled away from each other a little to shape the fused and sealed portion.

If the inside diameter of the neck 4 is made just a little larger than a diameter of the circle circumscribed with a group of mounds 13 of the stem 8, as shown in FIG. 9, a bottom (open end) of the neck 4 contacts the mounds 13 of the stem 8 in a sealing process.

Since the contact forms the sharp V-groove 14, it imposes a problem that there increases a danger of a crack occurring easily from the V-groove 14 in a completed cathode ray tube.

In view of solving the foregoing problems of the prior proposal, it is a second object of the present invention to provide a cathode ray tube having a diameter of a neck made as small as possible.

Still a third object of the present invention is to provide a method of manufacturing the cathode ray tube having a diameter of the neck made as small as possible.

Briefly, the foregoing second object is accomplished in accordance with aspects of the present invention by a cathode ray tube having a vacuum envelope comprising a panel supporting a phosphor film thereon, a neck housing an electron gun, a funnel joining the panel and the neck portion, and a stem sealing an open end of the neck and mounting the electron gun, wherein an inside diameter of a portion of the neck adjacent to the open end sealed by the stem, becomes gradually larger toward the open end sealed by the stem, or retains at least a value substantially equal to an inside diameter of a major portion of the neck.

Briefly, the foregoing third object is accomplished in accordance with aspects of the present invention by a method of manufacturing a cathode ray tube having a vacuum envelope comprising a panel supporting a phosphor film thereon, a neck housing an electron gun, a funnel joining the panel and the neck portion, and a stem sealing an open end of the neck and mounting the electron gun, the method comprising the steps of making an inside diameter of a portion of the neck adjacent to the open end sealed by the stem, gradually larger toward the open end sealed by the stem, preparing a stem with a diameter of its flange being larger than the maximum inside diameter of the portion of the neck adjacent to the open end, and sealing the stem to the open end of the neck.

In short, the present invention modifies a shape of an end portion of a neck and makes it possible to seal a small-diameter neck to a stem of a size determined elsewhere while a conventional sealing process for a cathode ray tube uses a neck of a uniform inside diameter and a uniform thickness.

As described above, in the cathode ray tube of the present invention an inside diameter of a portion of the neck adjacent to the open end sealed by the stem, becomes gradually larger toward the open end sealed by the stem, or retains at least a value substantially equal to an inside diameter of a major portion of the neck. Therefore, the cathode ray tube of the present invention has the advantage that the portion near the sealed end of the neck can be out of contact with the mounds of the stem. This will not form the sharp V-groove between the mounds and the end portion of the neck and eliminate occurrences of cracks near the sealed end.

As described above, the method of manufacturing the cathode ray tube of the present invention comprises the steps of making an inside diameter of a portion of the neck adjacent to the open end sealed by the stem, gradually larger toward the open end sealed by the stem, preparing a stem with a diameter of its flange being larger than the maximum inside diameter of the portion of the neck adjacent to the open end, and sealing the stem to the open end of the neck. Therefore, the present invention has the advantage that the cathode ray tube can employ a large-diameter stem used therefor without expansion of the outside diameter of a portion of the neck for housing the electron gun. The present invention also has the advantage that the small-diameter neck can reduce the power needed for deflecting the electron beams.

That is, the cathode ray tube of the present invention can use the small-diameter neck without deterioration in electrical characteristic of the stem so that the power for deflection of the electron beams can be reduced.

Since the power consumption for deflection of the electron beams decreases with a decreasing diameter of the neck of the cathode ray tube, power for an apparatus employing the cathode ray tube of the present invention can be saved.

BRIEF DESCRIPTION OF THE DRAWINGS

The present invention may be more fully understood by reference to the accompanying drawings in which.

DETAILED DESCRIPTION OF THE PREFERRED EMBODIMENTS

The following describes in detail embodiments according to the present invention by reference to the accompanying drawings.

Figure 11:
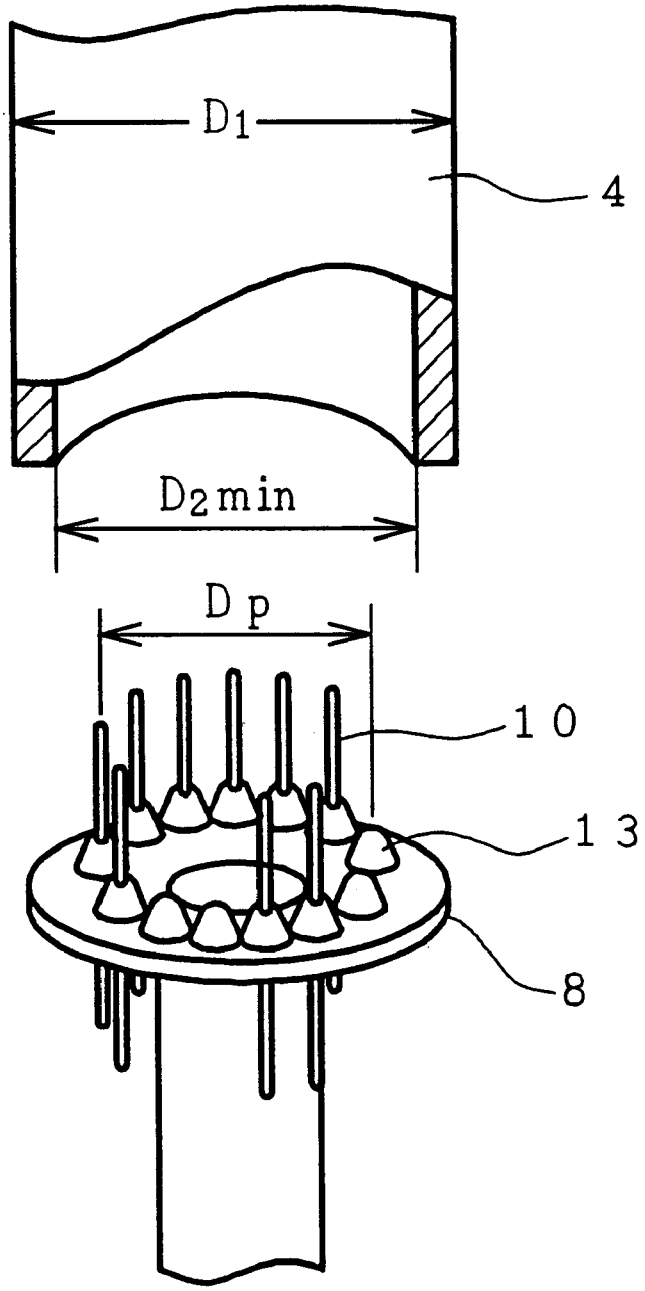
FIG. 11 is an exploded view of a neck and a stem of a cathode ray tube for explaining a dimensional relationship of the present invention and the prior art.

FIG. 11 depicts an exploded view illustrating a neck and a stem of a first embodiment of the cathode ray tube according to the present invention having a dimensional relationship as described below. In the figure are indicated a stem pin 10, a stem 8, and a neck 4 (hereinafter also referred to as the neck tube) joined with a funnel. The neck 4 and the stem 8 of a cathode ray tube are sealed with each other by heating and melting their respective portions butting to each other, with an electron gun (not shown) welded on stem pins 10 and inserted within the neck 4.

Table 1 below shows a neck of 29 mm in diameter used widely in prior color cathode-ray tubes, a neck of 24 mm in diameter, as an example, for illustration of the cathode ray tube of the present invention, and examples of stems sealed to them.

TABLE 1

| | | Cathode ray tube having neck of 29 mm diameter | Cathode ray tube having neck of 24 mm diameter |
|---|---|---|---|
| Neck | Outside diameter D1 | 29.1 mm | 24.3 mm |
| | Inside diameter D2 | 23.9 min. | 19.1 min. |
| Stem | Diameter Dp of pin circle | 15.24 | 12.0 |
| | Diameter of mound-circumscribed circle | 18.24 | |
| | Outside diameter Df of flange | 25.9 | |

In FIG. 11, as an example, the prior art sealed a stem having a pin circle of 15.24 mm in diameter Dp to a neck tube of 23.9 mm in minimum inside diameter $D_2$ min, or it has a stem having a pin circle of 12.0 mm in diameter Dp to a neck tube of 19.1 mm in minimum inside diameter $D^2$.

In case of these combinations, restrictions are imposed on the type of an electron gun to be employed for an inside diameter $D_2$ of a neck 4, due to relationship between the inside diameter $D_2$ and the number of stem pins. For example, a dynamic focus type electron gun that requires two focus pins can be incorporated into the so-called 29-mm neck tube of 23.9 mm in inside diameter only.

On the other hand, the present invention, as illustrated in FIG. 11, combines the diameter of a pin circle not smaller than 12.2 mm but not larger than 15.3 mm with the inside diameter of the neck of not smaller than 19.1 mm but smaller than 23.1 mm housing the electron gun. This makes it possible to seal the neck 4 and the stem 8 together.

Figure 12:
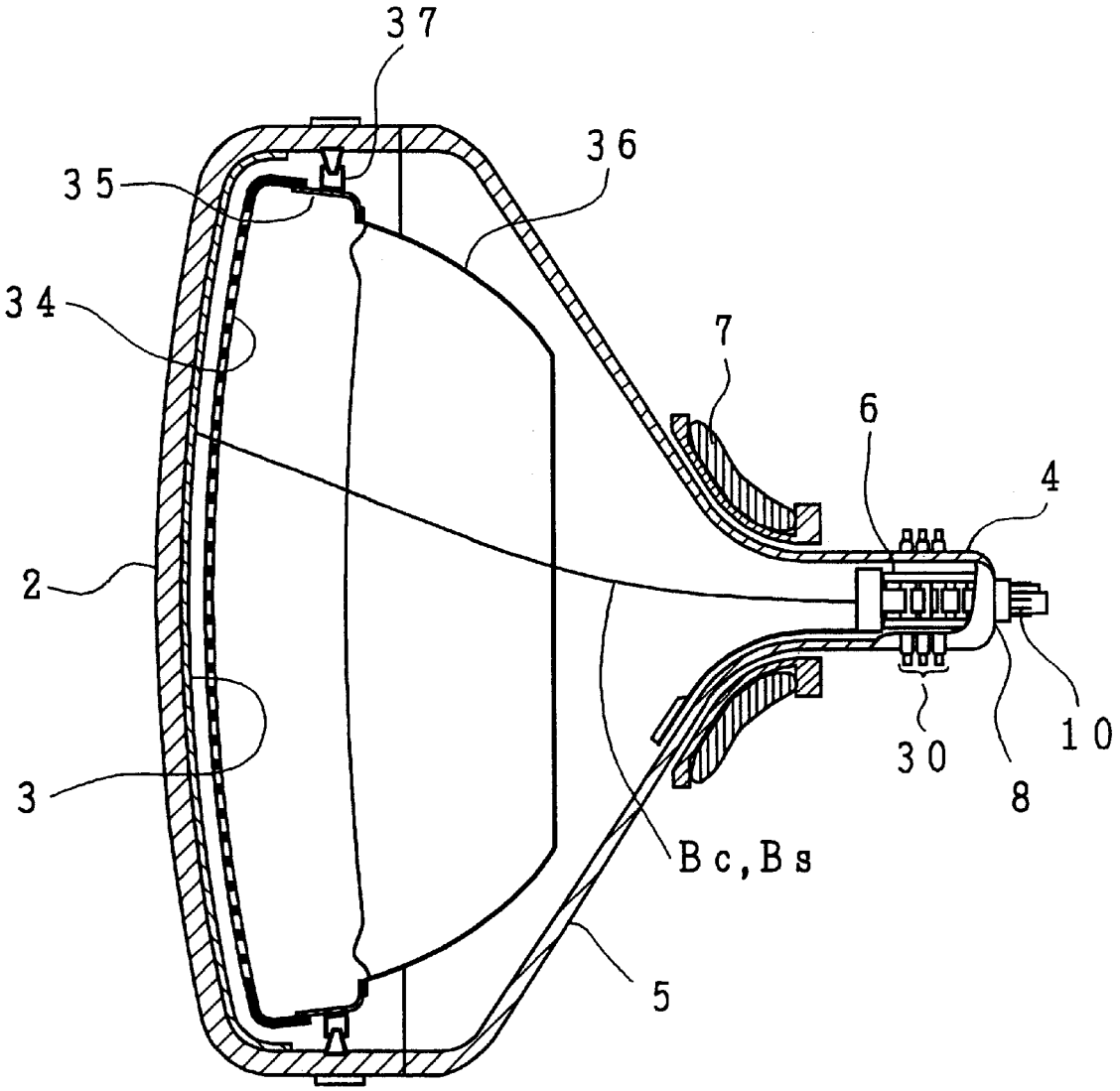
FIG. 12 is a cross-sectional view illustrating the whole structure of the first embodiment of the cathode ray tube according to the present invention.

FIG. 12 depicts a cross-sectional view illustrating the whole structure of the first embodiment of the cathode ray tube according to the present invention. In the figure are indicated the stem pin 10, the stem 8, a panel 2, the neck 4, the funnel 5, a phosphor film (phosphor screen) 3, a shadow mask 34, a mask frame 35, a magnetic shield 36, a shadow mask suspension mechanism 37, the electron gun 6, a deflection yoke 7, and an external magnetic device 30.

The color cathode ray tube has a vacuum envelope formed of the panel 2, the neck 4, and the funnel 5 joining the panel 2 with the neck 4.

The panel 2 has a screen formed of the phosphor film 3 coated with mosaic three-color phosphor on its inner surface. The neck 4 houses the electron gun 6 to emit three electron beams in line. The shadow mask 34 having a multiplicity of apertures is disposed in predetermined spaced relationship to the phosphor film 3.

The deflection yoke 7 is mounted in a transitional region between the funnel 5 and the neck 4.

In operation, the three electron beams Bc, Bs and Bs emitted by the above-described electron gun 6 are deflected horizontally and vertically by horizontal and vertical deflection magnetic fields produced by the deflection yoke 7, beams strike the desired phosphor after color selection by apertures of the shadow mask 34 to form a color image.

The first embodiment described above can accomplish the cathode ray tube having a combination of the inside diameter of a neck, the pin circle, and the type of electron gun that has not been realized by the prior arts.

Figure 1:
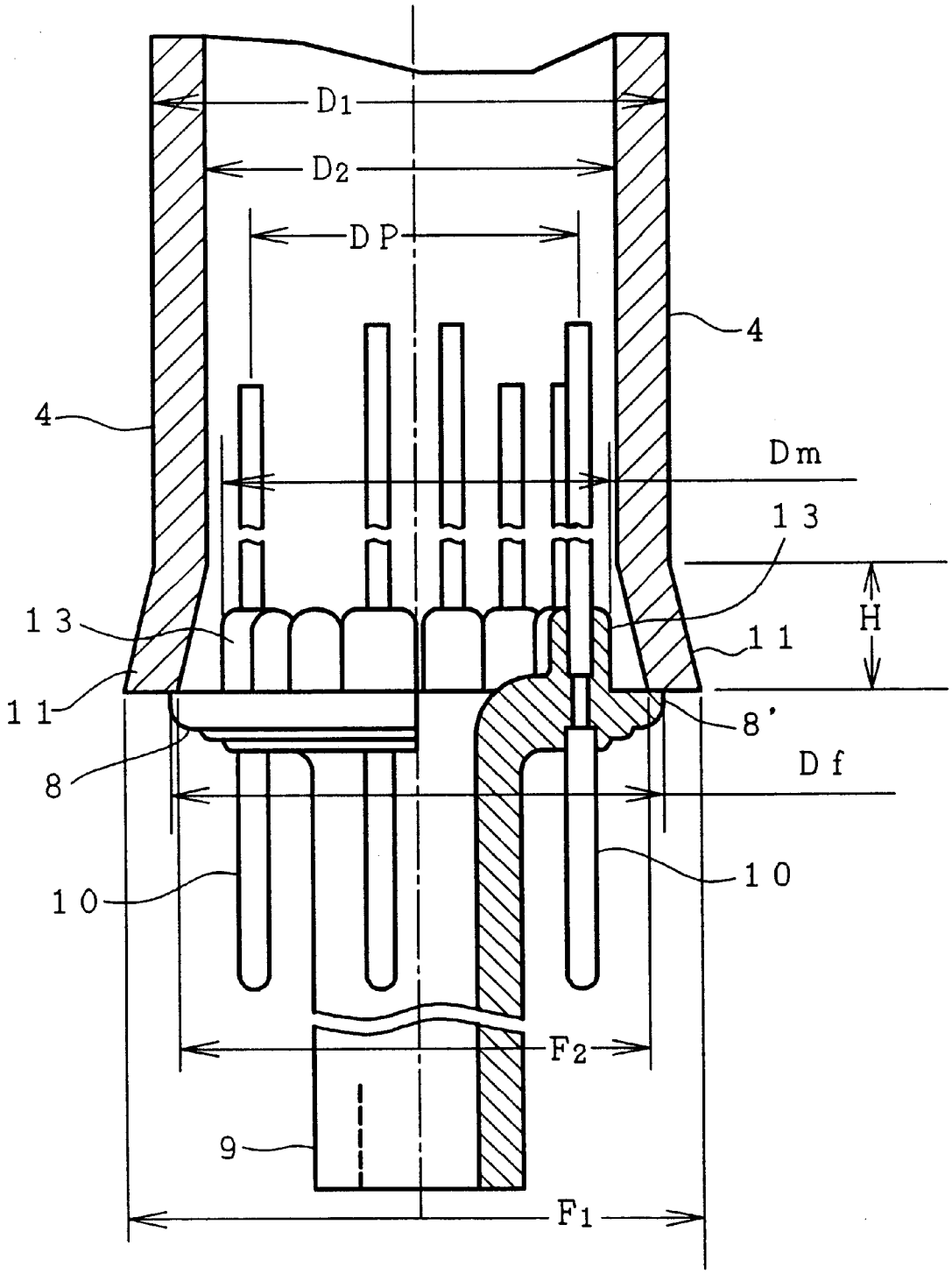
FIG. 1 is a partial cross-sectional view illustrating shapes of a neck and a stem of a second embodiment of the cathode ray tube according to the present invention before they are sealed.
Figure 2A:
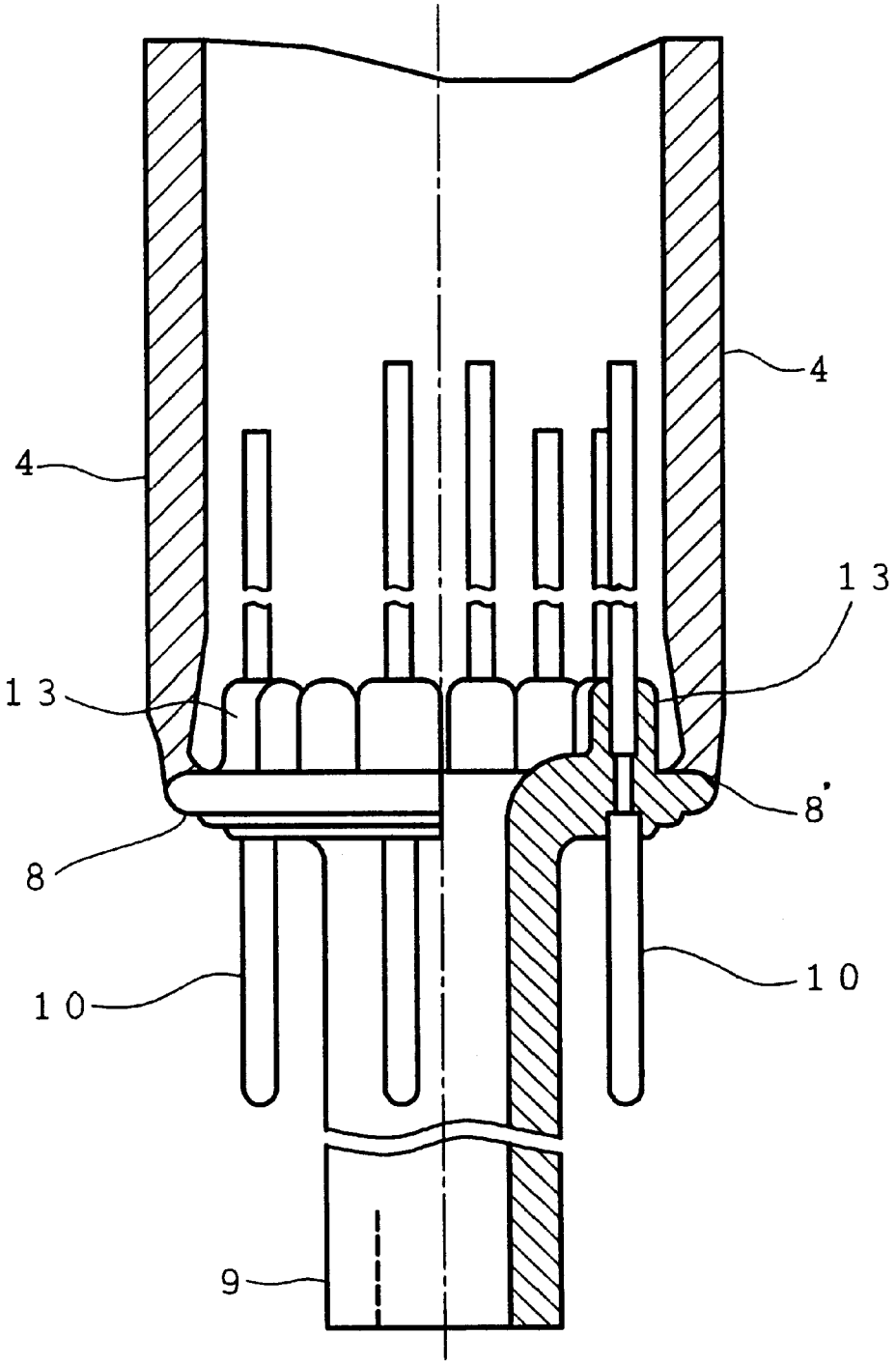
FIG. 2A is a partial cross-sectional view illustrating an example of a shape of the sealed neck and stem of the second embodiment of the cathode ray tube after they are sealed.
Figure 2B:
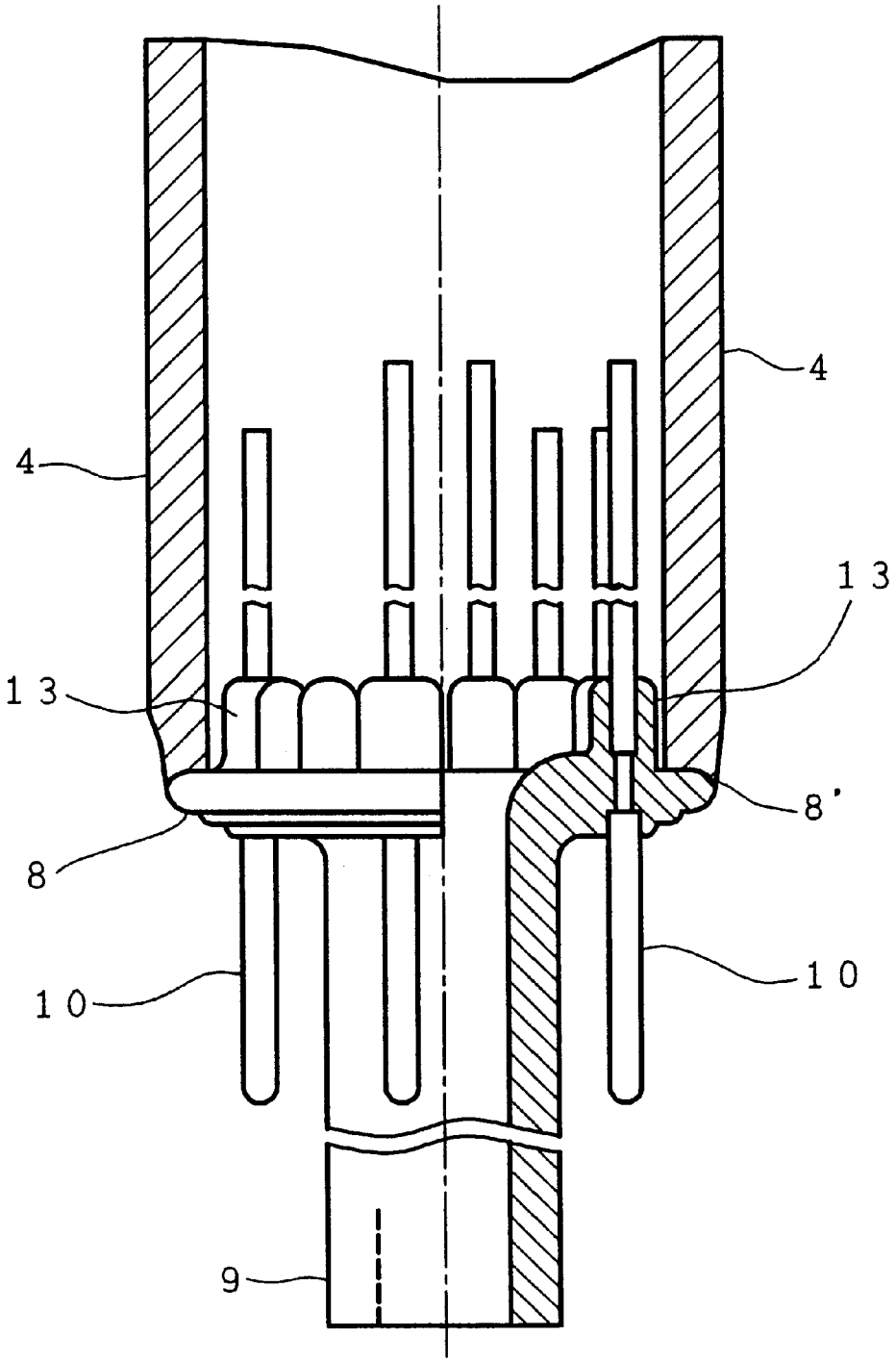
FIG. 2B is a partial cross-sectional view illustrating another example of a shape of the sealed neck and stem of the second embodiment of the cathode ray tube after they are sealed.

FIG. 1 depicts a partial cross-sectional view illustrating the shapes of a neck and a stem of a second embodiment of the cathode ray tube according to the present invention before the neck and the stem are sealed with each other. FIGS. 2A and 2B depict a partial cross-sectional view illustrating the shape of the sealed neck and stem of the second embodiment of the cathode ray tube after the neck and the stem are sealed. In the figures are indicated the neck 4, the stem 8 mounting the electron gun (not shown), a flange 8' of the stem, an exhaust tubulation 9, the stem pins 10, a flare 11, and mounds 13.

The neck 4 used in the second embodiment in FIG. 1 is the one for the cathode ray tube having a neck of 24 mm in diameter shown in Table 1 above. The stem 8 is the one of the cathode ray tube having a neck of 29 mm in diameter shown in Table 1.

The outside diameter $D_1$ and the inside diameter $D_2$ of the neck in Table 1 are values at a position sufficiently apart from ends of the neck 4. These dimensions are hereinafter referred to as the outside diameter and the inside diameter of a major portion of the neck, respectively. The diameter Dp of a pin circle is a diameter of a circle on which the stem pins 10 of the stem 8 are arranged. The diameter Dm of a mound-circumscribed circle is a diameter of a circle circumscribed with a plurality of mounds 13 arranged on the pin circle of diameter Dp of the stem 8.

In FIG. 1, the neck 4 is expanded at an open (lower) end thereof to form a flare, that is, the expanded portion 11. The flange 8' of the stem 8 is shaped to have a larger diameter than the maximum inside diameter of the expanded portion 11. Both the inside and outside diameters of the expanded portion 11 in the second embodiment increase at the same rate and the wall thickness of the expanded portion 11 is the same as that of the major portion of the neck 4.

As an example, dimensions of the expanded portion 11 of the first embodiment in FIG. 1 are as follows:

Outside diameter F1=26.2±0.7 mm,

Inside diameter F2=21.2±0.7 mm, and

Height H=8±2 mm.

As the neck 4 has the expanded portion 11 of the above dimensions, space between the inside wall of the neck 4 at the end and the mound 13 can be made wider.

In such a state as shown in FIG. 1, the expanded portion 11 and a circumference that is the flange 8' of the stem 8 are heated to melt. It is effective to hold the expanded portion 11 a little apart from the stem 8 to make heating easy.

The expanded portion 11 melted by heating is pressed to the stem 8 to seal. After that, the expanded portion 11 and the stem 8 are pulled apart a little so that the sealed portion should be made thinner to form a better shape.

The resultant sealed portion has a section as shown in FIG. 2A. The inside wall of the neck 4 is sealed without contact with the mounds 13 of the stem 8.

It is sufficient that the section of the sealed portion retains the inside diameter of the major portion of the neck 4 as shown in FIG. 2B. It is sufficient that the inside of the neck 4 does not contact the mounds 13 of the stem 8 at the sealed portion.

This embodiment provides a cathode ray tube featuring a high reliability free from occurrence of cracks in its sealed portion, a small-diameter neck without deterioration in the electron gun performance and a resultant low power consumption.

Figure 3:
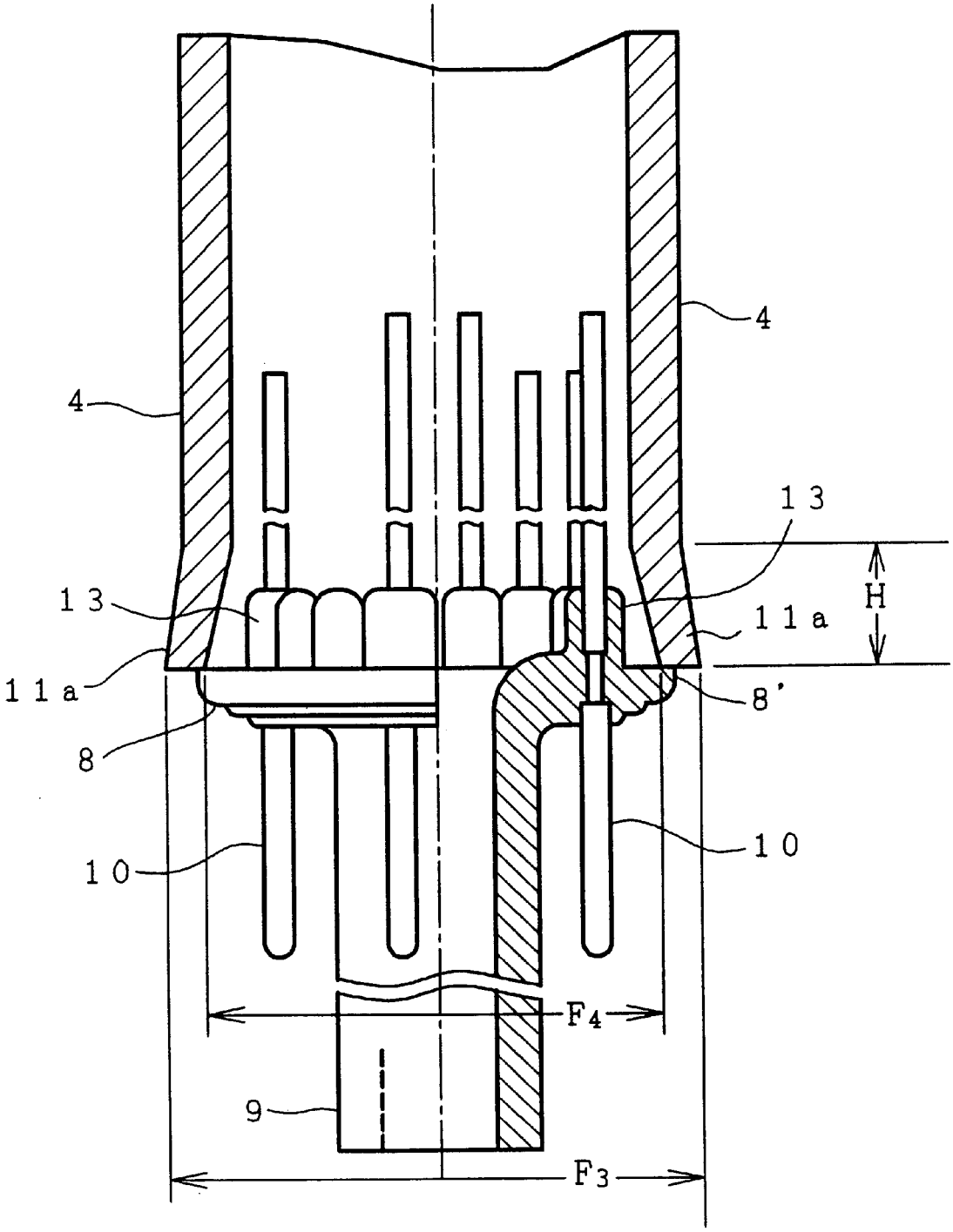
FIG. 3 is a partial cross-sectional view illustrating shapes of a neck and a stem of a third embodiment of the cathode ray tube according to the present invention before they are sealed.

FIG. 3 depicts a partial cross-sectional view illustrating the shapes of a neck and a stem of a third embodiment of the cathode ray tube according to the present invention before the neck and the stem are sealed. In the figure is indicated an expanded thin-wall portion 11*a*. The other parts in the figure identical with those in FIG. 1 are indicated by the same reference numerals as in FIG. 1.

The neck 4 used in the third embodiment in FIG. 3 is the one for the cathode ray tube having a neck of 24 mm in diameter shown in Table 1 above as in the first embodiment. The stem 8 is the one of the cathode ray tube having a neck of 29 mm in diameter shown in Table 1 as in the first embodiment.

The inside diameter of the neck 4 is expanded at an open (lower) end thereof to form the expanded-inside-diameter portion 11*a* as in the first embodiment. The expanded-inside-diameter portion 11*a* is different from the portion 11 of FIG. 1 in that the wall becomes thinner toward the end.

As an example, dimensions of the expanded thin-wall portion 11*a* of the second embodiment in FIG. 3 are as follows:

Outside diameter F3=25.2±0.7 mm,

Inside diameter F4=21.2±0.7 mm, and

Height H=8±2 mm

The expanded and thin-wall portion 11*a* melted by heating is pressed to the stem 8 to seal. The expanded thin-wall portion 11*a* and the stem 8 are pulled away from each other a little so that the sealed portion should be made thinner to improve the shape.

The resultant sealed portion has a section as shown in FIGS. 2A or 2B. The inside wall of the neck 4 is sealed out of contact with the mounds 13 of the stem 8.

This embodiment provides a cathode ray tube featuring a high reliability free from occurrence of cracks in its sealed portion, a small-diameter neck without deterioration in the electron gun performance and a resultant low power consumption.

Figure 4:
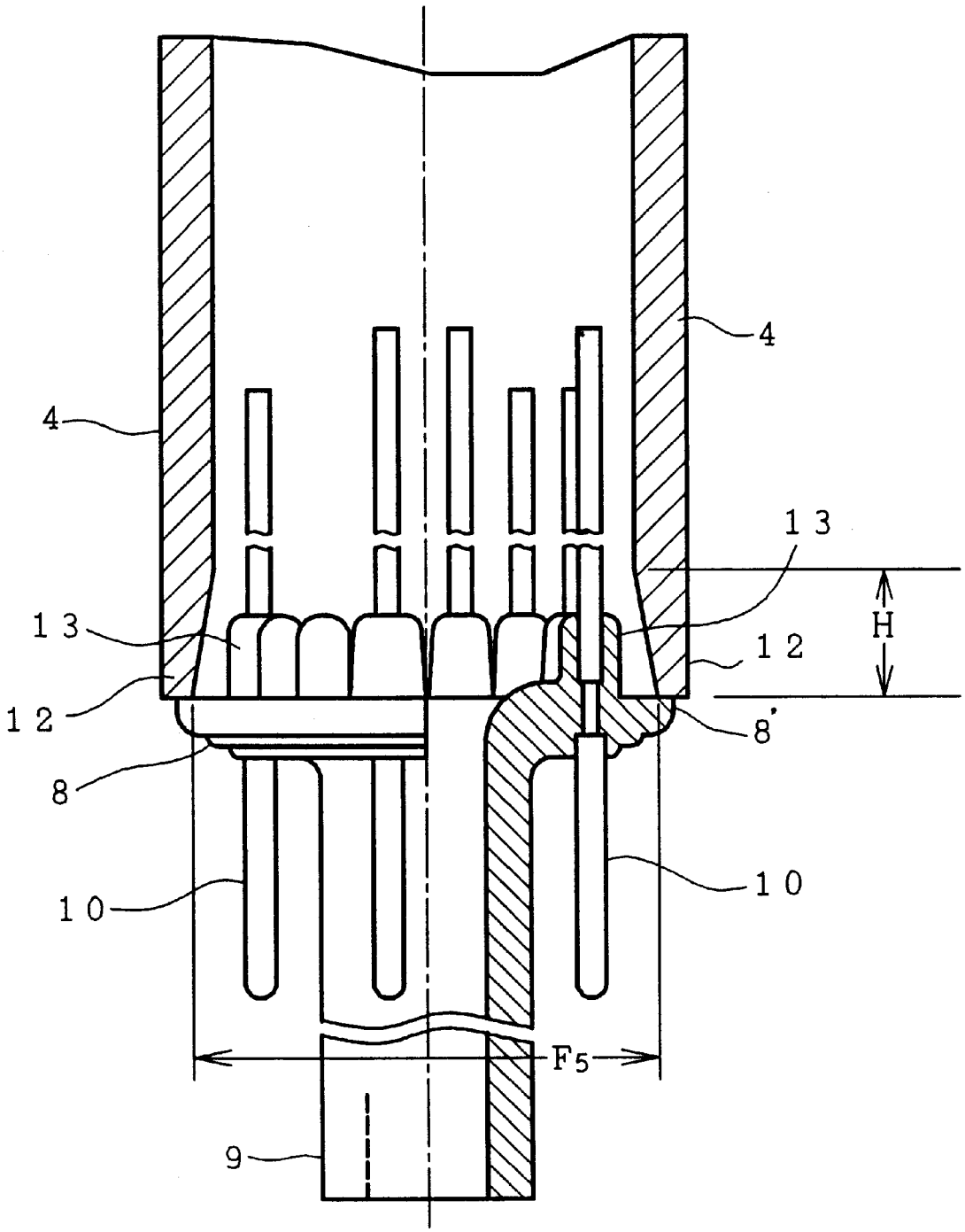
FIG. 4 is a partial cross-sectional view illustrating shapes of a neck and a stem of a fourth embodiment of the cathode ray tube according to the present invention before they are sealed.

FIG. 4 depicts a partial cross-sectional view illustrating the shapes of a neck and a stem of a fourth embodiment of the cathode ray tube according to the present invention before the neck and the stem are sealed. In the figure is indicated an expanded-inside-diameter portion 12 formed at an open end thereof. The other parts in the figure identical with those in FIG. 1 are indicated by the same reference numerals as in FIG. 1. The neck 4 used in the fourth embodiment in FIG. 4 is the one for the cathode ray tube having a neck of 24 mm in diameter shown in Table 1 above as in the second embodiment. The stem 8 is the one of the cathode ray tube having a neck of 29 mm in diameter shown in Table 1 as in the second embodiment.

In the fourth embodiment, the expanded-inside-diameter portion 12 has only the inside wall of the neck 4 near the open end becoming gradually larger toward the open end. The outside diameter of the flange 8' of the stem 8 is made larger than the maximum inside diameter of the expanded-inside-diameter portion 12. With this, space between the inside wall of the neck 4 at the end and the mounds 13 can be made wider.

As an example, dimensions of the expanded-inside-diameter portion 12 of the fourth embodiment in FIG. 4 are as follows:

Inside diameter F5=21.2±0.7 mm, and

Height H=8±2 mm.

Then, the expanded-inside-diameter portion 12 and a circumference of the stem 8 are heated to melt. The expanded-inside-diameter portion 12 and the stem 8 melted by heating is pressed together to seal.

The resultant sealed portion has a section as shown in FIG. 2A or 2B. The inside wall of the neck 4 is sealed out of contact with the mound 13 of the stem 8.

This embodiment provides a cathode ray tube featuring a high reliability free from occurrence of cracks in its sealed portion, a small-diameter neck without deterioration in the electron gun performance and a resultant low power consumption.

Figure 5:
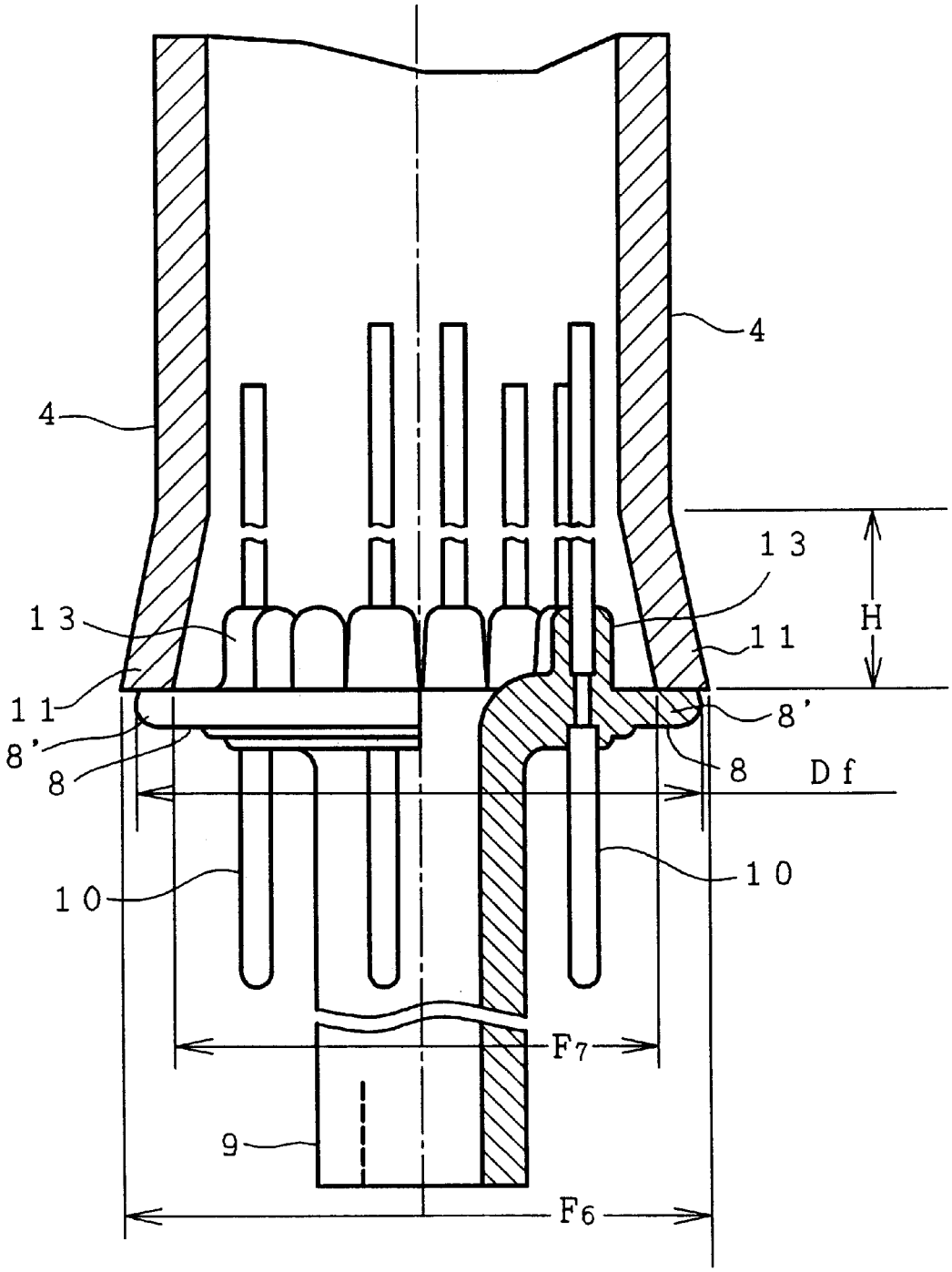
FIG. 5 is a partial cross-sectional view illustrating shapes of a neck and a stem of a fifth embodiment of the cathode ray tube according to the present invention before they are sealed.
Figure 6:
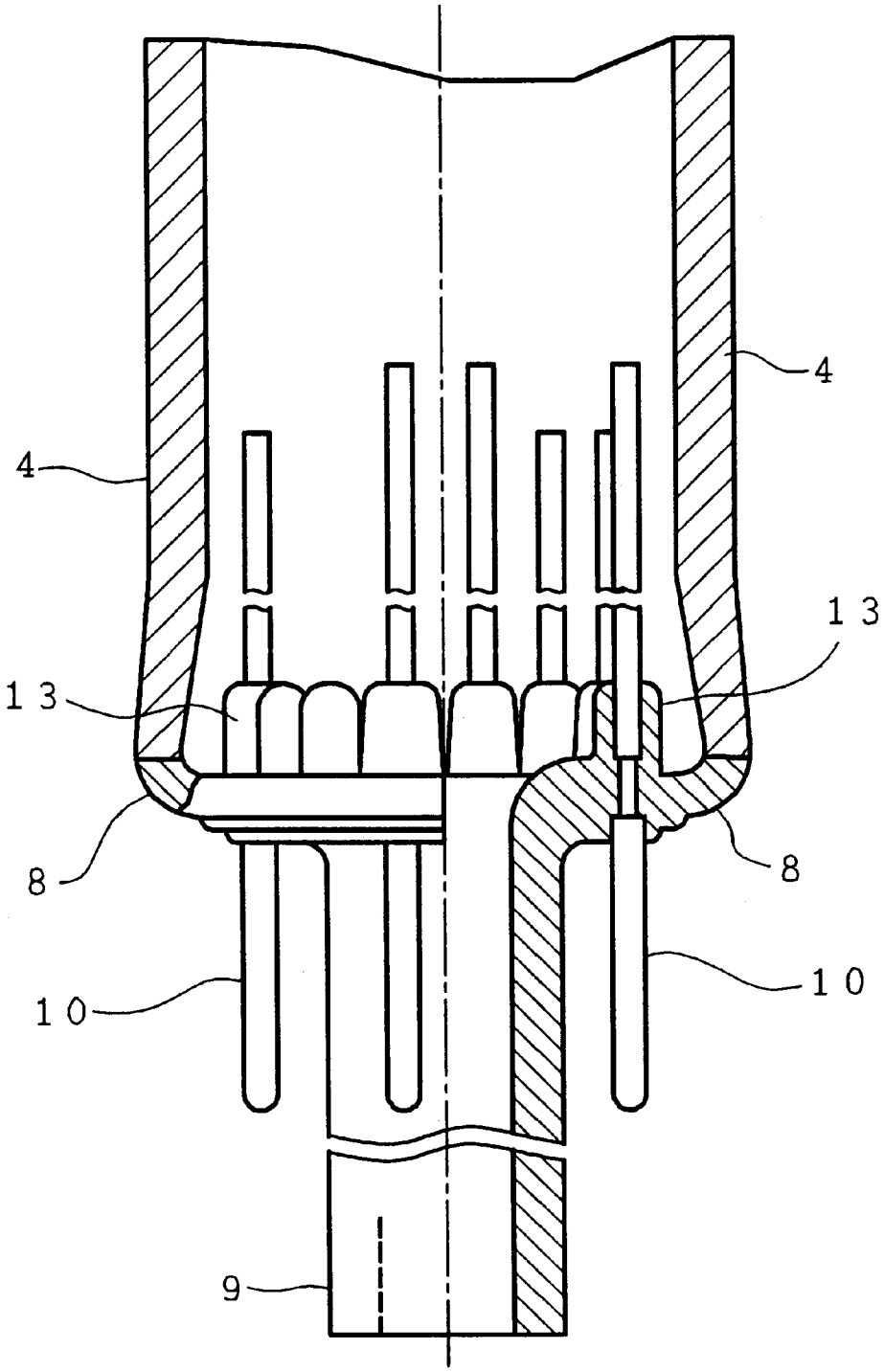
FIG. 6 is a partial cross-sectional view illustrating a shape of the sealed neck and stem of the fifth embodiment of the cathode ray tube after they are sealed.
Figure 7:
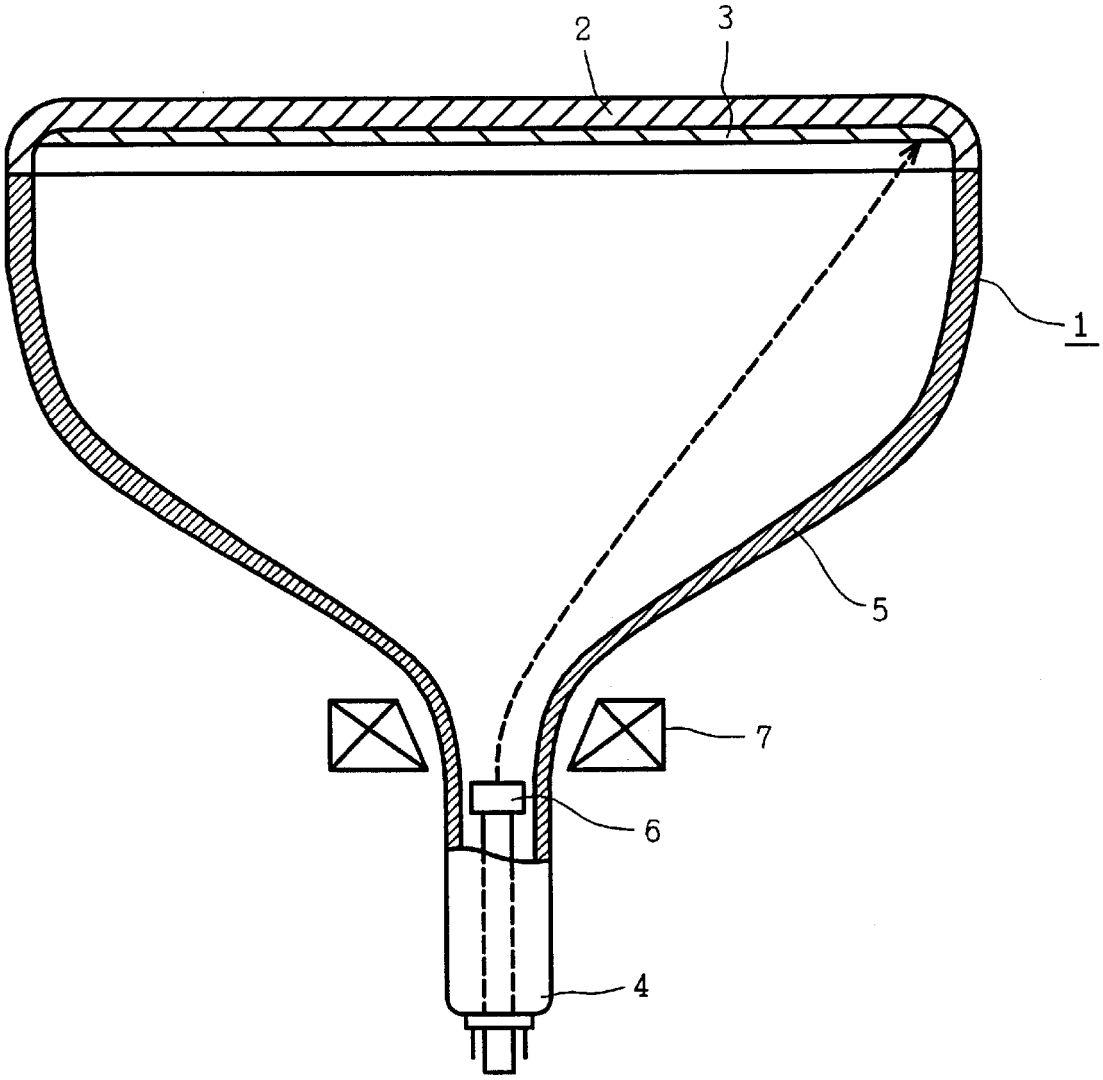
FIG. 7 PRIOR ART
FIG. 7 is a partial cross-sectional view illustrating a major portion of a cathode ray tube.
Figure 8:
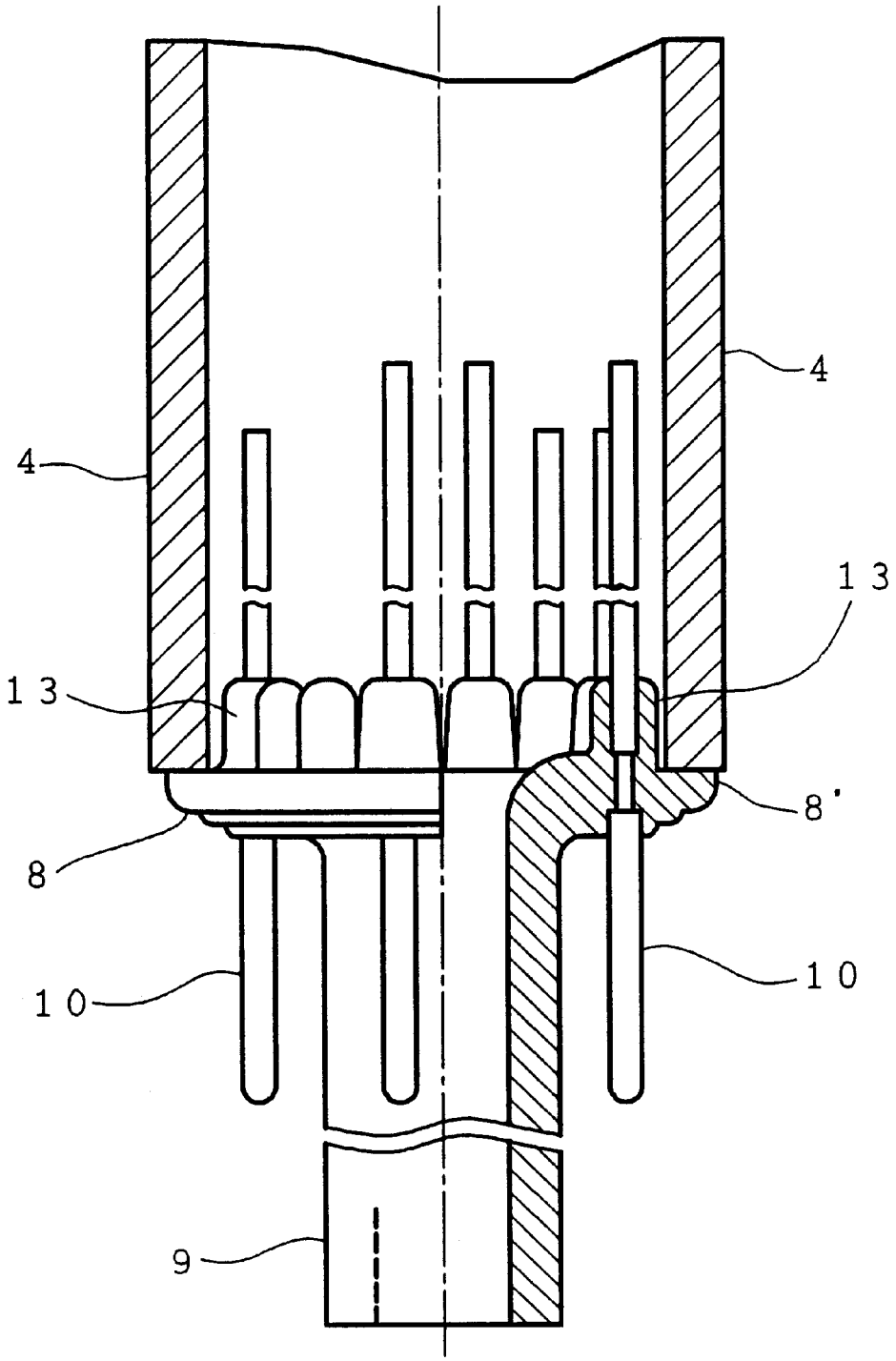
FIG. 8 PRIOR ART
FIG. 8 is a partial enlarged view illustrating the neck and stem of the cathode ray tube shown in FIG. 7 before they are sealed.
Figure 9:
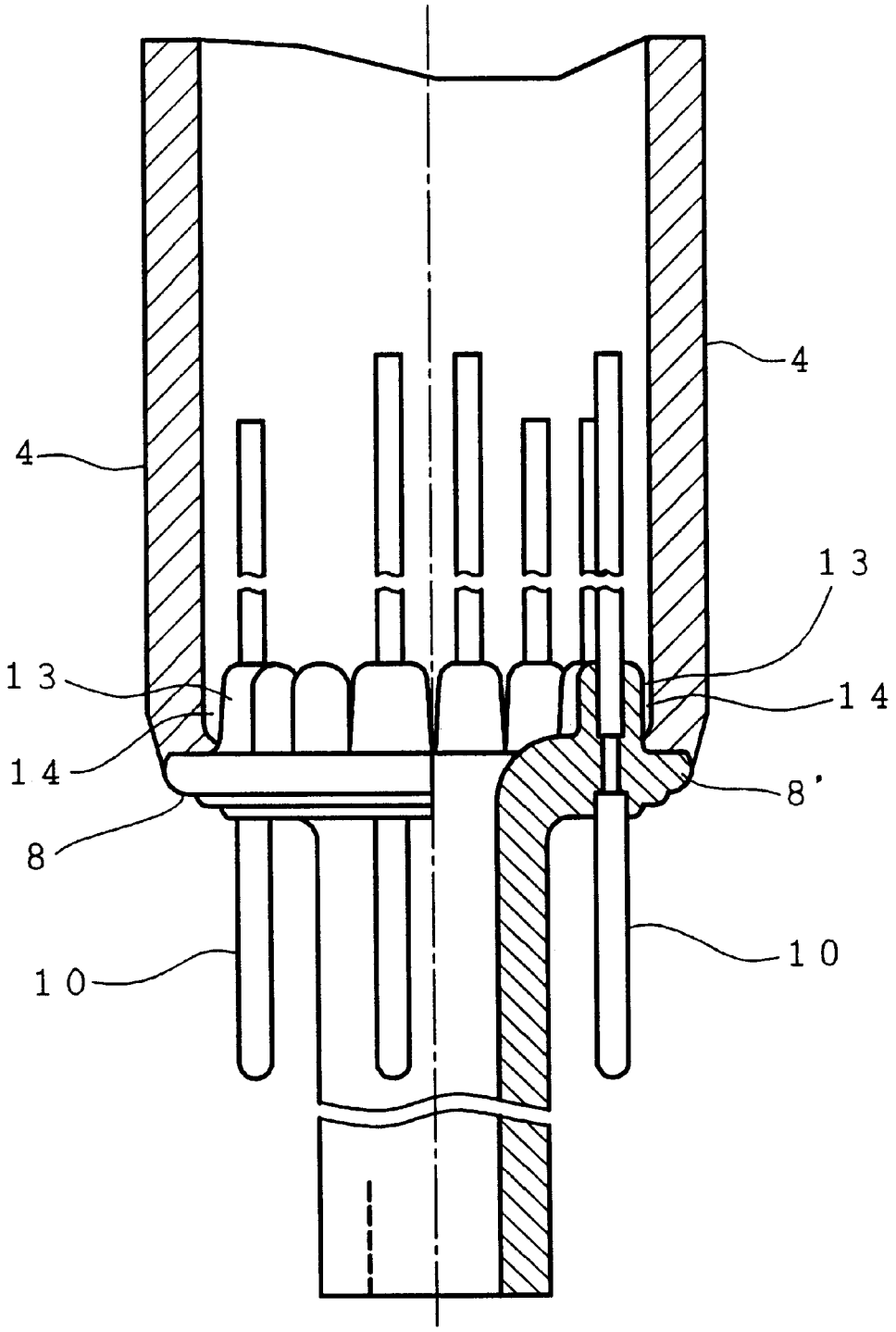
FIG. 9 PRIOR ART
FIG. 9 is a partial enlarged view illustrating the neck and stem of the cathode ray tube shown in FIG. 7 after they are sealed.
Figure 10:
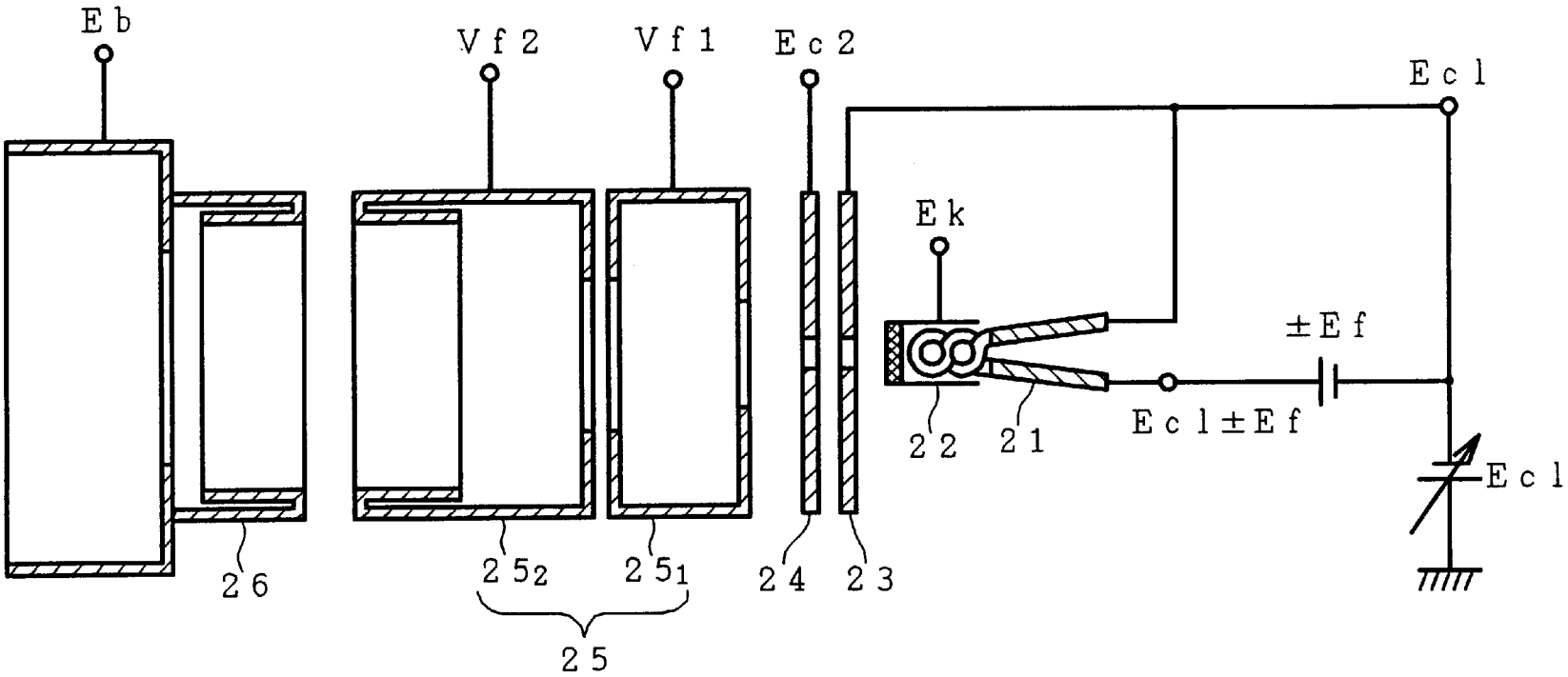
FIG. 10 PRIOR ART
FIG. 10 is a cross-sectional view illustrating the electron gun having a divided first and second focus electrodes, with the voltages applied to the electrodes.

FIG. 5 depicts a partial cross-sectional view illustrating the shapes of a neck and a stem of a fifth embodiment of the cathode ray tube according to the present invention before the neck and the stem are sealed. FIG. 6 depicts a partial cross-sectional view illustrating the shapes of the sealed neck and stem of the fifth embodiment of the cathode ray tube after the neck and the stem are sealed. Parts in the figure identical with those in FIG. 1 are indicated by the same numbers as in FIG. 1.

The neck 4 used in the fifth embodiment in FIG. 5 is the one for the cathode ray tube having a neck of 24 mm in diameter shown in Table 1 above. The stem 8 is the same one as that of the cathode ray tube having a neck of 29 mm in diameter shown in Table 1 except that the outside diameter of the flange is 26.9±0.4 mm.

The neck 4 is expanded at an open (lower) end thereof to form a flare, that is, a portion 11 expanding at a rate larger than that in the second embodiment. The flange 8' of the stem 8 is shaped to have a larger diameter than an outside diameter of the major portion of the neck 4 and the diameter of the flange of the stem in the second embodiment. With these, space between the inner wall of the neck 4 at the end thereof and the mounds 13 of the stem 8 can be made wider at the sealing portion.

As an example, dimensions of the expanded portion 11 of the embodiment in FIG. 5 are as follows:

Outside diameter F6=27.2±0.7 mm,

Inside diameter F7=22.2±0.7 mm, and

Height H=8±2 mm.

In such a state as shown in FIG. 5, the expanded portion 11 and a circumference, the flange 8' of the stem 8 are heated to melt. The expanded portion 11 and the stem 8 melted by heating are pressed together to seal. The shape of the sealed portions is shown in FIG. 6.

In FIG. 6, the sealed portion of the neck 4 is expanded and has an outside diameter a little larger than that of the major portion of the neck 4. The space between the inner wall of the neck 4 at the end thereof and the mounds 13 of the stem 8 can be made wider. The expansion in the outside diameter of the sealed portion of the neck is small enough not to hinder the neck from being inserted into the deflection yoke, posing no problem.

This embodiment provides a cathode ray tube featuring a high reliability free from occurrence of cracks in its sealed portion, a small-diameter neck without deterioration in the electron gun performance and a resultant low power consumption.

As described above, the cathode ray tube of the present invention has the advantages that the limitations on a combination of an inside diameter of the neck and a diameter of a circular array of stem pins are eased, and therefore a cathode ray tube having a small-diameter neck and a large-diameter circular array of stem pins, which has been impossible in prior art cathode ray tubes, is realized by adopting a compact electron gun in the cathode ray tube of the present invention, resulting in power savings by the neck diameter reduction and the improvement of focus characteristics by employing an electron gun of the dynamic focus type realized by the sufficient number of the stem pins consequent on the use of the large-diameter pin circle.

In short, the present invention can reduce the diameter of the neck of the cathode ray tube compared with the prior art without compromising the reliability and save the power consumption.

The present invention is particularly useful for the color cathode ray tube requiring many stem pins and the high resolution cathode ray tube employing the electron gun comprising a plurality of focus electrodes.

What is claimed is:

1. A cathode ray tube having a vacuum envelope comprising a panel supporting a phosphor film on an inner surface thereof, a neck housing an electron gun, a funnel joining said panel and said neck, and a stem sealing an open end of said neck and mounting said electron gun via a plurality of pins extending through said stem, wherein outside diameters in vicinities of a portion of said neck sealed by said stem become gradually larger in a direction toward said stem.

2. A cathode ray tube according to claim 1, wherein an outside diameter of a major portion of said neck is about 24.3 mm and a diameter of a circular array of said plurality of pins is not smaller than 12.2 mm and not larger than 15.3 mm.

3. A cathode ray tube according to claim 1, wherein a difference between an outside diameter of a major portion of said neck and a diameter of a circular array of said plurality of pins is not smaller than 9.0 mm and not larger than 12.1 mm.

4. A cathode ray tube according to claim 1, wherein inside diameters in said vicinities of said portion of said neck sealed by said stem become gradually larger in a direction toward said stem.

5. A cathode ray tube according to claim 1, wherein a wall thickness of said neck is thinner in said vicinities of said portion of said neck sealed by said stem than a wall thickness of a major portion of said neck.

6. A cathode ray tube according to claim 1, wherein inside diameters in said vicinities of said portion of said neck sealed by said stem are larger than a diameter of a circle circumscribed with a plurality of mounds implanting said plurality of pins therein.

7. A cathode ray tube according to claim 1, wherein an inside diameter of a major portion of said neck is at least 19.1 mm and less than 23.1 mm, and a diameter of a circular array of said plurality of pins is at least 12.2 mm and not larger than 15.3 mm.

8. A cathode ray tube according to claim 7, wherein said diameter of a circular array of said plurality of pins is about 15.24 mm.

9. A cathode ray tube according to claim 1, wherein said electron gun is a dynamic focus type electron gun and said plurality of pins includes at least nine pins arranged on a circumference of a circle and extending through said stem.

10. A cathode ray tube having a vacuum envelope comprising a panel supporting a phosphor film on an inner surface thereof, a neck housing an electron gun, a funnel joining said panel and said neck, and a stem sealing an open end of said neck and mounting said electron gun via a plurality of pins extending through said stem, wherein outside diameters in vicinities of a portion of said neck sealed by said stem become gradually larger in a direction toward said stem, and said stem has a flange with a diameter larger than a maximum of inside diameters of said neck in said vicinities of said portion of said neck sealed by said stem.

11. A cathode ray tube according to claim 10, wherein an outside diameter of a major portion of said neck is about 24.3 mm and a diameter of a circular array of said plurality of pins is at least 12.2 mm and not larger than 15.3 mm.

12. A cathode ray tube according to claim 10, wherein a difference between an outside diameter of a major portion of said neck and a diameter of a circular array of said plurality of pins is at least 9.0 mm and not larger than 12.1 mm.

13. A cathode ray tube according to claim 10, wherein said inside diameters in said vicinities of said portion of said neck sealed by said stem become gradually larger in a direction toward said stem.

14. A cathode ray tube according to claim 10, wherein a wall thickness of said neck is thinner in said vicinities of said portion of said neck sealed by said stem than a wall thickness of a major portion of said neck.

15. A cathode ray tube according to claim 10, wherein inside diameters in said vicinities of said portion of said neck sealed by said stem are larger than a diameter of a circle circumscribed with a plurality of mounds implanting said plurality of pins therein.

16. A cathode ray tube according to claim 10, wherein an inside diameter of a major portion of said neck is at least 19.1 mm and less than 23.1 mm, and a diameter of a circular array of said plurality of pins is at least 12.2 mm and not larger than 15.3 mm.

17. A cathode ray tube according to claim 16, wherein said diameter of a circular array of said plurality of pins is about 15.24 mm.

18. A cathode ray tube according to claim 10, wherein said electron gun is a dynamic focus type electron gun and said plurality of pins includes at least nine pins arranged on a circumference of a circle and extending through said stem.

19. A cathode ray tube having a vacuum envelope comprising a panel supporting a phosphor film on an inner surface thereof, a neck housing an electron gun, a funnel joining said panel and said neck, and a stem sealing an open end of said neck and mounting said electron gun via a plurality of pins extending through said stem, inside diameters in vicinities of said open end of said neck sealed by said stem becoming gradually larger toward said open end of said neck, wherein a wall thickness of said neck is thinner in vicinities of said open end of said neck than that of a major portion of said neck.

20. A cathode ray tube having a vacuum envelope comprising a panel supporting a phosphor film on an inner surface thereof, a neck housing an electron gun comprising at least a cathode, a control grid, an accelerating electrode, a focus electrode, an anode and a heater for heating said cathode for generating and directing an electron beam toward said phosphor film, a funnel joining said panel and said neck, and a stem sealing an open end of said neck, mounting said electron gun via a plurality of pins extending through said stem, and applying required voltages to said cathode, said grid, said electrodes, said anode and said heater, a diameter of a circular array of said plurality of pins is not smaller than 12.2 mm, but not larger than 15.3 mm, and an inside diameter of a major portion of said neck housing said electron gun is not smaller than 19.1 mm, but smaller than 23.1 mm.

21. A cathode ray tube having a vacuum envelope comprising a panel supporting a phosphor film on an inner surface thereof, a neck housing an electron gun, a funnel joining said panel and said neck, said neck having an inside diameter at a major portion thereof which is less than 23.1 mm, and a stem having at least nine pins arranged on a circumference of a circle and extending therethrough sealing an open end of said neck and for mounting said electron gun, inside diameters in vicinities of said open end of said neck sealed by said stem retaining at least a value substantially equal to the inside diameter of the major portion of said neck, and a wall thickness of said neck being thinner in said vicinities than that of the major portion of said neck.

* * * * *